US009835992B2

(12) United States Patent
Takane

(10) Patent No.: US 9,835,992 B2
(45) Date of Patent: Dec. 5, 2017

(54) IMAGE FORMING APPARATUS FOR SETTING STANDBY TEMPERATURE OF A FIXING DEVICE OF THE IMAGE FORMING APPARATUS, METHOD FOR CONTROLLING IMAGE FORMATION, AND RECORDING MEDIUM

(71) Applicant: Toshiaki Takane, Osaka (JP)

(72) Inventor: Toshiaki Takane, Osaka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/133,498

(22) Filed: Apr. 20, 2016

(65) Prior Publication Data

US 2016/0342115 A1 Nov. 24, 2016

(30) Foreign Application Priority Data

May 18, 2015 (JP) ..... 2015-101013

(51) Int. Cl.
*G03G 15/20* (2006.01)
*G03G 15/00* (2006.01)

(52) U.S. Cl.
CPC ..... *G03G 15/205* (2013.01); *G03G 15/5004* (2013.01)

(58) Field of Classification Search
CPC ..... G03G 15/205; G03G 15/2039; G03G 15/2078; G03G 15/5004
USPC ..... 399/33, 70; 219/216
See application file for complete search history.

(56) References Cited

U.S. PATENT DOCUMENTS

2009/0003867 A1* 1/2009 Fujimoto ..... G03G 15/2039 399/69
2009/0304401 A1* 12/2009 Hata ..... G03G 15/5004 399/33
2010/0119249 A1* 5/2010 Asaka ..... G03G 15/5004 399/70
2011/0188876 A1* 8/2011 Arakawa ..... G03G 15/20 399/70
2014/0270836 A1* 9/2014 Chosokabe ..... G03G 15/5016 399/70
2015/0253703 A1* 9/2015 Takane ..... G03G 15/2039 399/70

FOREIGN PATENT DOCUMENTS

JP 8-286556 11/1996
JP 10-010951 1/1998
JP 2004-163628 6/2004
JP 2005-202219 7/2005

(Continued)

*Primary Examiner* — Robert Beatty
(74) *Attorney, Agent, or Firm* — Harness, Dickey & Pierce, P.L.C.

(57) ABSTRACT

An image forming apparatus includes a fixing device, and a processor. The fixing device fixes an image formed on a recording medium at a fixing temperature. The fixing device includes a heater to heat the fixing device with power from a power supply. The processor detects a voltage value of the power supply, sets a standby temperature of the fixing device based on the detected voltage value of the power supply, and controls operation of the heater to heat the fixing device from the standby temperature to the fixing temperature in response to receiving an instruction for forming an image.

20 Claims, 8 Drawing Sheets

(56) References Cited

FOREIGN PATENT DOCUMENTS

| | | | | |
|---|---|---|---|---|
| JP | 2007240719 | A | * | 9/2007 |
| JP | 2013186196 | A | * | 9/2013 |
| JP | 2015-169662 | | | 9/2015 |
| JP | 2015-180907 | | | 10/2015 |
| JP | 2015-210355 | | | 11/2015 |

* cited by examiner

| POWER SUPPLY VOLTAGE [V] | CHANGE AMOUNT OF STANDBY TEMPERATURE [°C] |
|---|---|
| 90 – 91 | 0.0 |
| 91 – 92 | 0.5 |
| 92 – 93 | 1.0 |
| 93 – 94 | 1.5 |
| 94 – 95 | 2.0 |
| 95 – 96 | 2.5 |
| 96 – 97 | 3.0 |
| 97 – 98 | 3.5 |
| 98 – 99 | 4.0 |
| 99 – 100 | 4.5 |
| 100 – 101 | 5.0 |
| 101 – 102 | 5.5 |
| 102 – 103 | 6.0 |
| 103 – 104 | 6.5 |
| 104 – 105 | 7.0 |
| 105 – 106 | 7.5 |
| 106 – 107 | 8.0 |
| 107 – 108 | 8.5 |
| 108 – 109 | 9.0 |
| 109 – 110 | 9.5 |

IMAGE FORMING APPARATUS FOR SETTING STANDBY TEMPERATURE OF A FIXING DEVICE OF THE IMAGE FORMING APPARATUS, METHOD FOR CONTROLLING IMAGE FORMATION, AND RECORDING MEDIUM

CROSS-REFERENCE TO RELATED APPLICATION

This patent application is based on and claims priority pursuant to 35 U.S.C. §119(a) to Japanese Patent Application No. 2015-101013, filed on May 18, 2015, in the Japan Patent Office, the entire disclosure of which is hereby incorporated by reference herein.

BACKGROUND

Technical Field

The present disclosure relates to an image forming apparatus, a method for controlling image formation, and a non-transitory recording medium.

Description of the Related Art

An image forming apparatus is known that includes a fixing device maintained at a predetermined temperature until the image forming apparatus receives an instruction to start image formation. For example, in a time-saving mode, the fixing device is heated and maintained at a standby temperature until the start of image formation in order to shorten a time period taken for image formation compared with a normal mode. In response to receiving an instruction to form an image in such standby state, a heater, which is provided with the fixing device, heats the fixing device to a predetermined fixing temperature with power from a power supply. The standby temperature is set so that it does not cause fixing failure even when the voltage of the power supply is at a lower limit according to a product standard.

SUMMARY

An image forming apparatus includes a fixing device and a processor. The fixing device fixes an image formed on a recording medium at a fixing temperature. The fixing device includes a heater to heat the fixing device with power from a power supply. The processor detects a voltage value of the power supply, sets a standby temperature of the fixing device based on the detected voltage value of the power supply, and controls operation of the heater to heat the fixing device from the standby temperature to the fixing temperature in response to receiving an instruction for forming an image.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
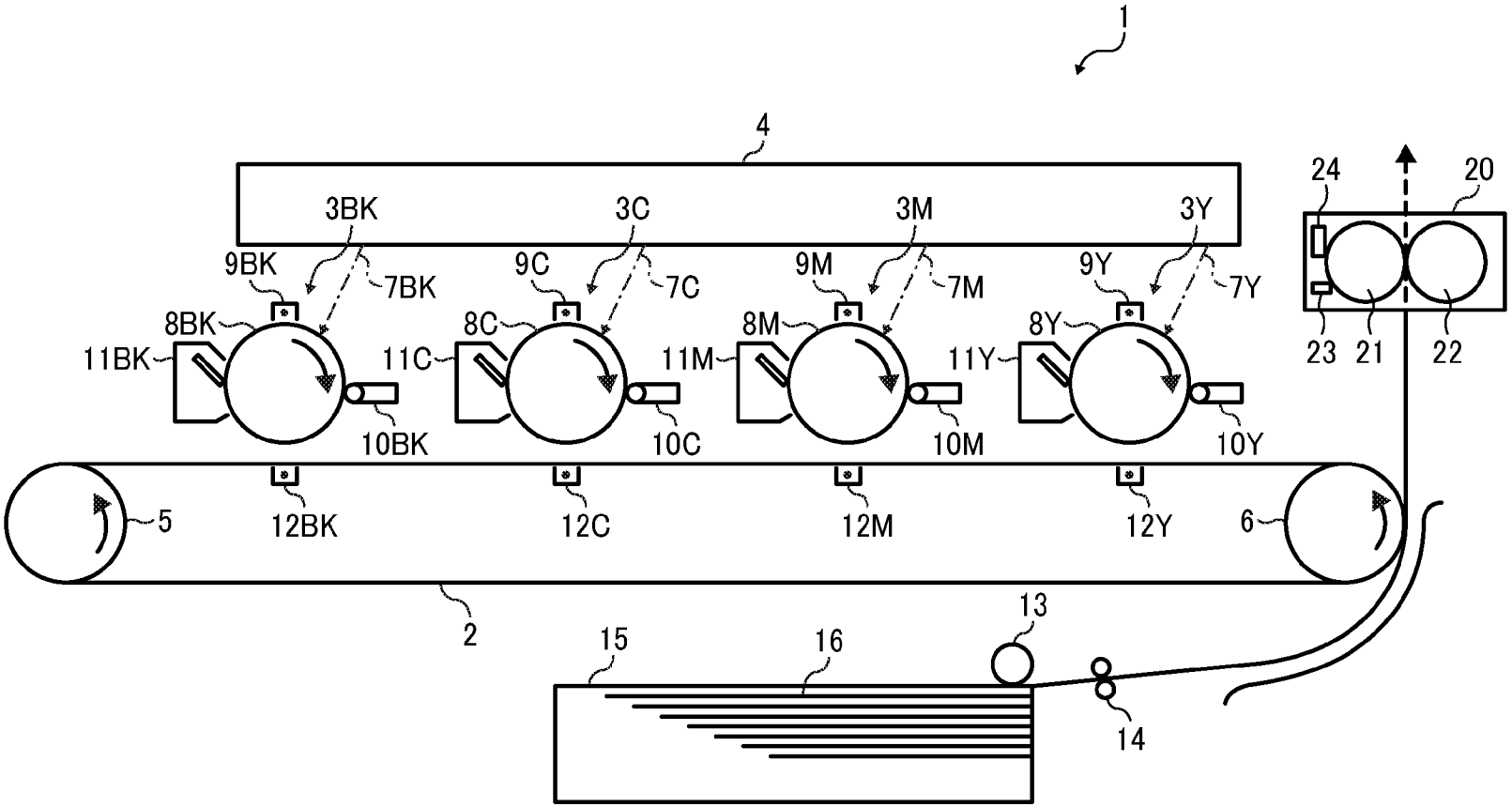
FIG. 1 illustrates a schematic view of an image forming apparatus according to an exemplary embodiment of the present invention.

The accompanying drawings are intended to depict example embodiments of the present invention and should not be interpreted to limit the scope thereof. The accompanying drawings are not to be considered as drawn to scale unless explicitly noted.

DESCRIPTION OF THE EMBODIMENTS

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the present disclosure is not intended to be limited to the specific terminology so selected and it is to be understood that each specific element includes all technical equivalents that operate in a similar manner.

Hereinafter, a description is given of an image forming apparatus, a method for controlling image formation, and a non-transitory recording medium according to several exemplary embodiments of the present invention.

Figure 2:
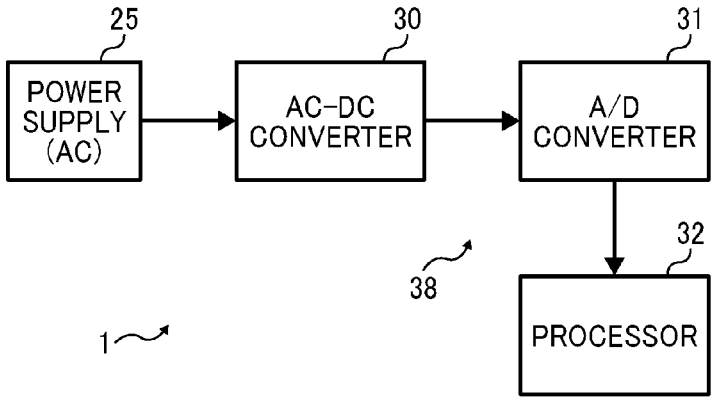
FIG. 2 is a block diagram illustrating a hardware configuration to detect a voltage value of a power supply in the image forming apparatus of FIG. 1.

An image forming apparatus 1 according to the following embodiments may be any apparatus as long as it forms an image using a fixing device. Examples of such an image forming apparatus 1 include a printer, a facsimile, a copier, or a multifunction peripheral (MFP) having multiple functions such as a printer function, a copier function, a scanner function, and a facsimile function. The image forming apparatus 1 according to the following embodiments operates on power from a power supply 25 (FIG. 2).

Hereinafter, a description is given of embodiments of the image forming apparatus 1 that supports an electrophotography system as an example.

FIG. 1 illustrates a schematic view of the image forming apparatus 1 according to an exemplary embodiment.

As illustrated in FIG. 1, the image forming apparatus 1 is a tandem printer, including an intermediate transfer belt 2, a plurality of image forming units (electrophotographic processors) 3Y, 3M, 3C, and 3BK, which are disposed side by side along the intermediate transfer belt 2, and a writing unit 4. The intermediate transfer belt 2 is an endless belt, which is stretched over a drive roller 5 and a driven roller 6. A driver actuates the drive roller 5 to rotate. In accordance with the rotation of the drive roller 5, the intermediate transfer belt 2 rotates.

The image forming units 3Y, 3M, 3C, and 3BK are disposed side by side along a conveyance direction of the intermediate transfer belt 2, and respectively form toner images of different colors on the surface of the intermediate transfer belt 2. The writing unit 4 irradiates the image forming units 3Y, 3M, 3C, and 3BK with exposure light rays corresponding to image data of different colors, (e.g., light beams 7Y, 7M, 7C, and 7BK) to write electrostatic latent images of respective colors onto the image forming units 3Y, 3M, 3C, and 3BK. The image forming units 3Y, 3M, 3C, and 3BK are substantially similar in configuration with one another. Accordingly, a description is given of the image forming unit 3Y as an example. Elements and configurations included in the image forming unit 3Y are denoted by the suffix—Y, whereas the corresponding elements or configurations included in the image forming units 3M, 3C, and 3BK are denoted by the suffix—M, C, and BK, respectively.

The image forming unit 3Y includes an image bearer 8Y, a charging device 9Y, a developing device 10Y, and a discharging device 11Y, which are disposed around the outer circumference of the image bearer 8Y. In this example, the image bearer 8Y is a photoconductor having a drum shape. In advance of image formation, the charging device 9Y uniformly charges the outer circumferential surface of the image bearer 8Y in the dark. The writing unit 4 irradiates the charged outer circumferential surface of the image bearer 8Y with the light beam 7Y, which corresponds to an image of yellow color, to form an electrostatic latent image on the surface of the image bearer 8Y. The developing device 10Y develops the electrostatic latent image with yellow toner to form a visible yellow toner image on the surface of the image bearer 8Y. A transfer device 12Y transfers the toner image formed on the image bearer 8Y onto the intermediate transfer belt 2 at a first transfer position, where the image bearer 8Y contacts with the intermediate transfer belt 2. After this transfer of the toner image to the intermediate transfer belt 2, a cleaner removes residual toner on the outer circumferential surface of the image bearer 8Y. Subsequently, the discharging device 11Y discharges the image bearer 8Y.

The intermediate transfer belt 2 rotates while carrying the toner image transferred thereonto such that the toner image moves to the image forming unit 3M. The image forming unit 3M forms a magenta toner image on the surface of the image bearer 8M, and transfers the magenta toner image onto the surface of the intermediate transfer belt 2 such that the magenta toner image is overlaid on the yellow toner image. In substantially the same manner, the image forming unit 3C transfers a cyan toner image formed on the surface of the image bearer 8C onto the surface of the intermediate transfer belt 2. The image forming unit 3BK also transfers a black toner image formed on the surface of the image bearer 8BK onto the surface of the intermediate transfer belt 2 in substantially the same manner. Thus, the toner images of four different colors are transferred onto the surface of the intermediate transfer belt 2, overlaid one atop the other so that a colored toner image is formed on the surface of the intermediate transfer belt 2.

The image forming apparatus 1 further includes a feed roller 13, a pair of separation rollers 14, and a sheet tray 15. The feed roller 13 rotates to convey a sheet 16 accommodated in sheet tray 15 in cooperation with the separation rollers 14, in accordance with the rotation and movement of the intermediate transfer belt 2. The sheet 16 is an example of a recording medium, which is a medium on which an image is to be formed. Examples of the recording medium may include a recording paper, a recording sheet, and a recording material. The sheet 16 is conveyed to a second transfer position, where the sheet is brought into contact with the intermediate transfer belt 2, such that the toner image formed on the surface of the intermediate transfer belt 2 is transferred onto the sheet 16. After this transfer of the toner image onto the sheet 16, the sheet passes through a fixing device 20, which fixes the toner image to form (print) the colored image on the sheet 16. The sheet having the printed image thereon is ejected to the outside of the image forming apparatus 1.

The fixing device 20 fixes the toner image on the sheet 16, and includes a pair of rollers (i.e., a fixing roller 21 and a pressure roller 22), a thermistor 23, and a thermostat 24. The fixing roller 21 and the pressure roller 22 are disposed side by side. The pressure roller 22 presses the fixing roller 21 with a predetermined pressure. The thermistor 23 is an example of a temperature detector that detects a temperature of the fixing roller 21. In this example, thermistor 23 detects a surface temperature of the fixing roller 21. The thermistor 23 further outputs a temperature reading of the fixing roller 21 to a control unit 33 (FIG. 3) of the image forming apparatus 1.

The thermostat 24 is an example of a heating device that heats the fixing roller 21. The thermostat 24 heats a heater with power from the power supply 25 to cause the heater to heat the fixing roller 21. The thermostat 24 is also an example of an adjuster that adjusts the temperature (surface temperature) of the fixing roller 21. The thermostat 24 controls the passage of electric current through the heater to adjust and maintain the temperature of the fixing roller 21. The control unit 33 (FIG. 3) of the image forming apparatus 1 causes the thermostat 24 to control the temperature of the fixing roller 21 based on the temperature of the fixing roller 21 detected by the thermistor 23.

While forming an image, the thermostat 24 heats the fixing roller 21 to maintain the fixing roller 21 at a predetermined temperature. A driver such as a drive motor rotates the fixing roller 21 and the pressure roller 22 to cause the sheet 16 to pass through between the fixing roller 21 and the pressure roller 22. While the sheet passes through between the fixing roller 21 and the pressure roller 22, the pressure roller 22 pressurizes the sheet 16 and the fixing roller 21 heats the sheet 16 to fix an image (toner image) on the sheet 16. The fixing device 20 is thus heated by power from the power supply 25, which is provided outside the image forming apparatus 1, to apply heat to the sheet 16. Further, the fixing device 20 heats the toner image formed on the sheet 16 to fix the image on the sheet 16 with heat.

Hereinafter, a description is given in detail of an operation of controlling the temperature of the fixing device 20 by the image forming apparatus 1.

In response to receiving an instruction to select the time-saving mode from a user, the image forming apparatus 1 causes the thermostat 24 to maintain the temperature of the fixing device 20 at a predetermined standby temperature. In this example, the thermostat 24 maintains the temperature of the fixing roller 21 at the standby temperature. In the time-saving mode, it takes less time for the image forming apparatus 1 to form an image than it does in a normal mode. The image forming apparatus 1 receives an instruction to select the time-saving mode through an input to a control panel provided with the image forming apparatus 1. The standby temperature is a temperature of the fixing device 20 in a standby state, where the image forming apparatus waits for the start of image formation.

In the time-saving mode, the thermostat 24 heats the fixing device 20 to maintain the temperature of the fixing device 20 at the standby temperature. The image forming apparatus 1 and the fixing device 20 keeps waiting for receiving an instruction to form an image in such standby state. In response to receiving the instruction to form an image during the standby state, the image forming apparatus 1 causes the thermostat 24 to heat the fixing device 20 such that the temperature of the fixing device is raised up to a predetermined fixing temperature, which is higher than the standby temperature. Because, in the time-saving mode, the fixing device 20 is heated and maintained in advance at the standby temperature, a time period taken for heating the fixing device 20 up to the fixing temperature is shortened. Accordingly, it takes less time for the image forming apparatus 1 to form an image than it does in a normal mode. In this example, the image forming apparatus 1 determines the standby temperature of the fixing device 20 based on a voltage value of the power supply 25, and controls the temperature of the fixing device 20 according to the determination result.

FIG. 2 is a block diagram illustrating a configuration to detect the voltage value of the power supply 25 in the image forming apparatus 1.

As illustrated in FIG. 2, the image forming apparatus 1 includes an alternating current (AC) to direct current (DC) converter 30, which is connected to the power supply 25, an analog to digital (A/D) converter 31, and a processor 32. The power supply 25 is a commercial AC power supply as a main power supply, which supplies power to the image forming apparatus 1. The AC-DC converter 30 is a power supply device that converts AC power to DC power. The AC-DC converter 30 converts AC power supplied from the power supply 25 to DC power, which is suitable for use by the image forming apparatus 1, to convert an AC voltage value to a DC voltage value.

The A/D converter 31 measures the DC voltage value, which is converted from the AC voltage value by the AC-DC converter 30, and converts the measured DC voltage value to digital data. Further The A/D converter 31 outputs the digital data, which is converted from the DC voltage value, to the processor 32. The processor 32 is implemented by, for example, a micro processing unit (MPU) or a central processing unit (CPU) that carries out various arithmetic and logical operations. The processor 32 also constitutes a part of the control unit 33 of the image forming apparatus 1 and carries out arithmetic and logical operations of controlling operation of the image forming apparatus 1.

Figure 3:
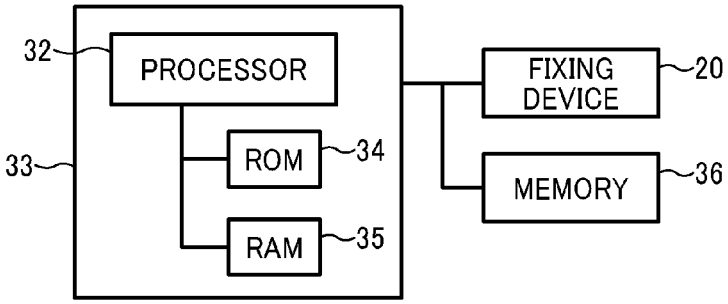
FIG. 3 is a block diagram illustrating a hardware configuration of the image forming apparatus of FIG. 1.

FIG. 3 is a block diagram illustrating configurations of the control unit 33 of the image forming apparatus 1 and some elements or devices of the image forming apparatus 1 that are connected to the control unit 33.

As illustrated in FIG. 3, the control unit 33 includes the processor 32, a read only memory (ROM) 34, and a random access memory (RAM) 35. The ROM 34 stores therein various programs including a program executed by the processor 32. The RAM 35 temporarily stores data used by the processor 32 when carrying out arithmetic and logical processing or information processing. The control unit 33 is connected to the fixing device 20 and a memory 36, and controls operation of the image forming apparatus 1. The memory 36 is implemented by, for example, a storage device such as a hard disk drive (HDD). The control unit 33 and the processor 32 each acquires data from the memory 36, and carries out various operations based on the data acquired from the memory 36.

The image forming apparatus 1 includes various units as described below that implement various functions, which are implemented by the processor 32 of the control unit 33, when executing according to the program stored in the ROM 34 using the RAM 35 as a work area. For example, the processor 32 of the control unit 33 executes the program stored in the ROM 34 to implement a temperature control unit 37 (FIG. 4), which controls operation of the thermostat 24 of the fixing device 20 to change the temperature of the fixing device 20. Specifically, the temperature control unit 37 controls operation of the thermostat 24 to change the temperature of the fixing device 20 to the fixing temperature, at which the image is fixed on the sheet 16, or to the standby temperature, which is lower than the fixing temperature. Further, the processor 32 of the control unit 33 detects the AC voltage value supplied from the power supply 25 based on the DC voltage value acquired from the A/D converter 31 (see FIG. 2). In this example, the processor 32 detects an actual value of the voltage or a maximum value of the voltage as the AC voltage value.

For example, the control unit 33 (the processor 32) acquires, from the memory 36, a voltage value conversion table that stores a relation between the DC voltage values and the AC voltage values. The control unit 33 acquires the AC voltage value that is associated with the DC voltage value acquired from the A/D converter 31 based on the obtained voltage value conversion table to detect the voltage value supplied from the power supply 25. Alternatively, the control unit 33 may acquire, from the memory 36, a relational expression that represents a relation between the DC voltage value and the AC voltage value. The control unit 33 calculates the AC voltage value from the DC voltage value acquired from the A/D converter 31 using the obtained relational expression. Thus, the AC-DC converter 30, the A/D converter 31, and the processor 32 of the control unit 33 constitute an example of a voltage value detection unit 38 (FIG. 4) that detects the voltage value of the power supply 25.

Figure 4:
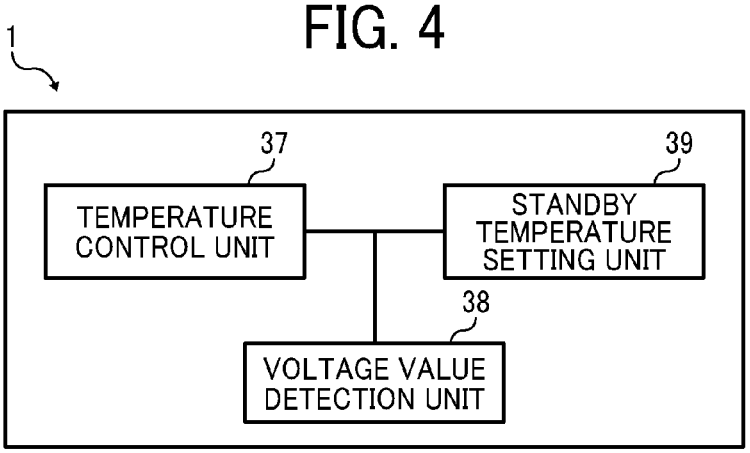
FIG. 4 is a block diagram illustrating a functional configuration of the image forming apparatus of FIG. 1.

FIG. 4 is a block diagram illustrating a functional configuration of a part of the image forming apparatus 1.

As illustrated in FIG. 4, the image forming apparatus 1 includes a standby temperature setting unit 39, in addition to the temperature control unit 37 and the voltage value detection unit 38, which are described above. The standby temperature setting unit 39 sets the standby temperature of the fixing device 20 based on the voltage value detected by the voltage value detection unit 38. Specifically, the controller 33 causes the processor 32 to perform an operation as described below of setting of the standby temperature to implement the standby temperature setting unit 39.

Figure 5:
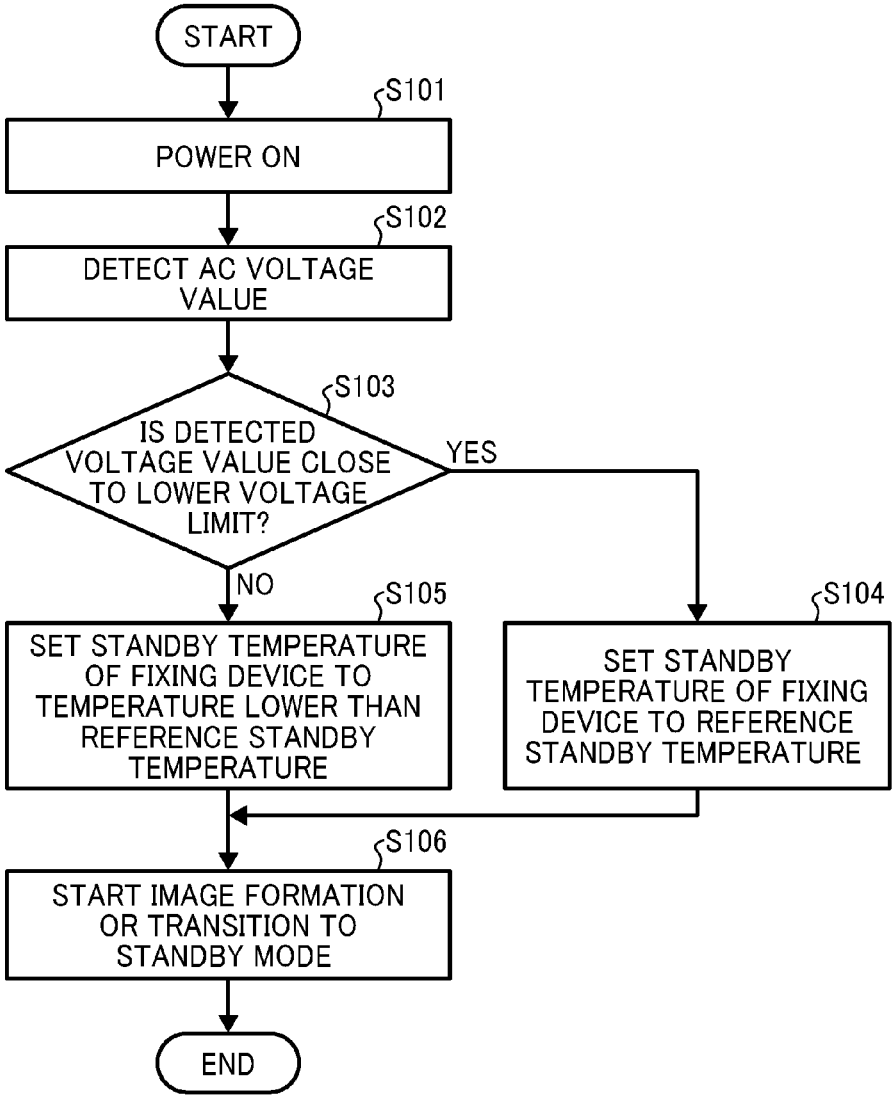
FIG. 5 is a flowchart illustrating an operation of controlling temperature of a fixing device of the image forming apparatus of FIG. 1.

FIG. 5 is a flowchart illustrating an operation of controlling the temperature of the fixing device 20. Specifically, the flowchart illustrates an operation of controlling the temperature of the fixing device 20 in the time-saving mode.

As illustrated in FIG. 5, when the image forming apparatus 1 is turned on (S101), the voltage value detection unit 38 detects the AC voltage value of the power supply 25 (S102). The standby temperature setting unit 39 changes the setting of the standby temperature from a predetermined reference standby temperature based on the detected voltage value of the power supply 25 to set the standby temperature of the fixing device 20. Specifically, the standby temperature setting unit 39 determines whether to change the setting of the standby temperature of the fixing device 20 from the predetermined reference temperature based on the detected voltage value of the power supply 25. When the standby temperature setting unit 39 determines that the setting of the standby temperature is to be changed, the standby temperature setting unit 39 acquires a change amount of the standby temperature based on the detected voltage value of the power supply 25. In other words, the processor 32 as the standby temperature setting unit 39 executes the program stored in the ROM 34 to perform the operation of determining whether to change the setting of the standby temperature and the operation of acquiring the change amount of the standby temperature.

In this exemplary embodiment, the reference standby temperature of the fixing device 20 corresponds to a lower limit of the voltage value (referred to as a "lower voltage limit" hereinafter) of the power supply 25. The reference standby temperature is an upper limit of the standby temperature of the fixing device 20 in the standby state. The lower voltage limit of the power supply 25 and the reference standby temperature each is set in advance and stored in the memory 36. The standby temperature setting unit 39 compares the detected voltage value of the power supply 25 with the lower voltage limit. Based on the comparison result, the standby temperature setting unit 39 determines whether to change the setting of the standby temperature of the fixing device 20 to a lower value from the reference standby temperature. In other words, the processor 32 executes the program stored in the ROM 34 to perform the operation of comparing the voltage value of the power supply 25 with the lower voltage limit and the operation of determining whether to change the setting of the standby temperature based on the comparison result.

Specifically, the standby temperature setting unit 39 compares the detected voltage value of the power supply 25 with the lower voltage to determine whether the voltage value of the power supply 25 is close to the lower voltage limit. More specifically, the standby temperature setting unit 39 determines whether a voltage difference, which is obtained by subtracting the lower voltage limit from the voltage value of the power supply 25, is less than a predetermined acceptable value. When the standby temperature setting unit 39 determines that the voltage difference is less than the predetermined acceptable value, the standby temperature setting unit 39 determines that the voltage value of the power supply 25 is close to the lower voltage limit (S103: YES). The acceptable value of the voltage difference is set in advance and stored in the memory 36.

When the standby temperature setting unit 39 determines that the voltage value of the power supply 25 is close to the lower voltage limit (S103: YES), the standby temperature setting unit 39 does not change the setting of the standby temperature of the fixing device 20 from the predetermined reference standby temperature (S104). In contrast, when the standby temperature setting unit 39 determines that the voltage difference is greater than or equal to the predetermined acceptable value, the standby temperature setting unit 39 determines that the voltage value of the power supply 25 is not close to the lower voltage limit (S103: NO). Based on such determination result, the standby temperature setting unit 39 sets the standby temperature of the fixing device 20 to a temperature that is lower than the reference standby temperature (S105). With the operation as described above, the standby temperature setting unit 39 sets the standby temperature of the fixing device 20.

After S105, the image forming apparatus 1 starts forming an image, or the fixing device 20 transitions to the standby state in which the fixing device 20 keeps waiting for the start of image formation (S106). In a case where the image forming apparatus 1 starts forming an image at S106, the image forming units 3Y, 3M, 3C, and 3BK starts forming an image on the sheet 16. Further, the thermostat 24 heats the fixing device 20 up to the fixing temperature with power supplied from the power supply 25 so that the unfixed toner image formed on the sheet 16 is fixed on the sheet 16 with heat of the fixing device 20. In a case where the fixing device is kept in the standby state at S106, the thermostat 34 heats the fixing device 20 up to the standby temperature, and maintains the temperature of the fixing device 20 at the standby temperature. More specifically, at S106, the thermostat 34 heats the fixing device 20 up to the reference standby temperature corresponding to the lower voltage limit, when the standby temperature setting unit 39 does not change the setting of the standby temperature of the fixing device 20 at S104. In contrast, at S106, the thermostat 34 heats the fixing device 20 up to the standby temperature that is changed from the reference standby temperature, when the standby temperature setting unit 39 changes the setting of the standby temperature at S105.

The temperature of the fixing device 20 is maintained at the standby temperature that is set at S104 or S105 until the start of image forming. In response to receiving the instruction to form an image during such standby state, the image forming apparatus 1 causes the thermostat 24 to heat the fixing device 24 up to the fixing temperature from the standby temperature such that the unfixed toner image formed on the sheet 16 is fixed onto the sheet 16 with heat of the fixing device 20. When the image formation ends, the thermostat 24 changes the temperature of the fixing device 20 to the standby temperature. Then, the fixing device 20 again keeps waiting for the start of image formation at the standby temperature. The temperature control unit 37 controls operation of the thermostat 24 to change the temperature of the fixing device 20 to the fixing temperature, at which the fixing device 20 fixes the image on the sheet 16, or to the standby temperature, at which the fixing device 20 is kept in the standby state. Further, the standby temperature setting unit 39 acquires the change amount of the standby temperature corresponding to the voltage value of the power supply 25 based on a predetermined conversion table. The standby temperature setting unit 39 sets the standby temperature of the fixing device 20 based on the acquired change amount of the standby temperature.

Figures 6, 7:
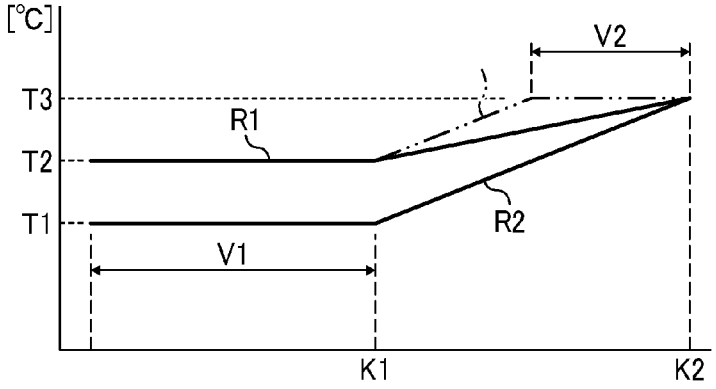
FIG. 6 is a view illustrating an example of a conversion table according to an embodiment of the present invention.
FIG. 7 is a graph illustrating variation in temperature of the fixing device of the image forming apparatus of FIG. 1.

FIG. 6 is a view illustrating an example of the conversion table used by the stand by temperature setting unit 39 for acquiring the change amount of the standby temperature according to an embodiment of the present invention. In the example illustrated in FIG. 6, a standard of a power supply voltage of the image forming apparatus 1 is 90V or more and 110V or less. The upper voltage limit is 110V while the lower voltage limit is 90V. In the conversion table illustrated in FIG. 6, N-M (except for 109-110) represents N or more and less than N. 109-110 represents 109 or more and 110 or less.

As illustrated in FIG. 6, the conversion table defines the change amount of the standby temperature corresponding to the voltage value of the power supply 25, and represents a relation between the voltage value of the power supply 25 and the change amount of the standby temperature. Specifically the conversion table stores pieces of data, which are combinations of the voltage value of the power supply 25 and the change amount of the standby temperature. The conversion table is set in advance and stored in the memory 36. For example, when the voltage value of the power supply 25 is 90V, the standby temperature setting unit 39 does not change the setting of the standby temperature from the reference standby temperature based on the determination indicating that the voltage value of power supply 25 is close to the lower voltage limit. Accordingly, in the conversion table, the voltage value of 90-91V is associated with the change amount of 0.0 degree Celsius. In contrast, when the voltage value of the power supply 25 is 91V or more, the change amounts of the standby temperature are set in accordance with the voltage values of the power supply 25. The higher the voltage value, the greater is the change amount of the standby temperature.

The standby temperature setting unit 39 acquires the conversion table from the memory 36 to convert the voltage value of the power supply 25 to the change amount of the standby temperature based on the conversion table. Thus, the standby temperature setting unit 39 acquires the change amount of the standby temperature corresponding to the voltage value of the power supply 25. The standby temperature setting unit 39 changes the setting of the standby temperature from the reference standby temperature based on the acquired changed amount of the standby temperature. In this example, the standby temperature setting unit 39 subtracts the change amount from the reference standby temperature to set the standby temperature of the fixing device 20 at a temperature that is lower than the reference standby temperature.

FIG. 7 is a graph illustrating variation in the temperature of the fixing device 20 of the image forming apparatus 1 according to an embodiment of the present invention. The graph includes two examples of the temperature variation, which are represented by R1 and R2, respectively. Further, the graph also illustrates a dashed line F that represents a comparative example of the temperature variation resulting from a temperature control according to a typical fixing device. In FIG. 7, the graph shows a temperature and a time period in vertical and horizontal axes respectively.

As illustrated in FIG. 7, in the comparative example (F), the standby temperature of the typical fixing device is set to T2 only, which corresponds to the lower voltage limit, such that no fixing failure occurs even when the voltage of the power supply is a lower voltage limit according to a product standard. Accordingly, in the comparative example, the fixing device may consume a larger amount of power than is necessary in the standby state (V1).

Specifically, in the comparative example, the fixing device keeps waiting in the standby state (V1) for the start of image formation at the standby temperature T2, and the heating of the fixing device is started at K1 such that the temperature of fixing device is raised up to the fixing temperature T3. However, the voltage value of the power supply is often greater than the lower voltage limit of a product standard. Accordingly, in such a case where the voltage value of the power supply is close to a power rating (100V, for example), the temperature of the fixing device reaches the standby temperature T3 before image fixing is started at K2. The fixing device is maintained at the fixing temperature T3 during a time period V2 until the fixing of image is started at K2. As a result, in the comparative example, a larger amount of power than necessary may be consumed in order to keep the temperature of the fixing device at the fixing temperature T3.

In contrast, the image forming apparatus 1 according to this exemplary embodiment detects the voltage value of the power supply 25, and performs the operation of controlling the temperature of the fixing device 20 based on the detected voltage value. Specifically, as in the example represented by R1, in a case where the voltage value of the power supply 25 is relatively low (90V, for example, which is the lower voltage limit), the standby temperature of the fixing device 20 is set to T2, which is relatively high and corresponds to the reference standby temperature. Accordingly, the fixing device 20 is kept in the standby state (V1) at the standby temperature T2. Then, in response to the start of image formation, the heating of the fixing device 20 is started at K1 such that the temperature of the fixing device 20 is raised up to the fixing temperature T3. The fixing device 20 is heated from the standby temperature T2 for a heating time period and at a heating speed, each corresponding to the voltage value of the power supply 25. The temperature of the fixing device 20 reaches the fixing temperature T3 at the same time or nearly the same time of the start of image formation (K2).

Further, as in the example represent by R2, in a case where the voltage value of the power supply 25 is higher than the lower voltage limit (100V, for example), the standby temperature of the fixing device 20 is set to T1, which is lower than the reference standby temperature. In other words, the setting of the standby temperature of the fixing device 20 is changed to a lower temperature from the reference standby temperature based on the voltage value of the power supply 25. The fixing device 20 is kept in the standby state (V1) at the standby temperature T1. Then, in response to the start of image formation, the heating of the fixing device 20 is started at K1 such that the temperature of the fixing device 20 is raised up to the fixing temperature T3. The fixing device 20 is heated from the standby temperature T1 for a heating time period and at a heating speed, each corresponding to the voltage value of the power supply 25. The temperature of the fixing device 20 reaches the fixing temperature T3 at the same time or nearly the same time of the start of image formation (K2). Accordingly, an excessive consumption of power is suppressed for keeping the temperature of the fixing device at the standby temperature T1 during the standby state (V1) and for heating the fixing device 20 up to the fixing temperature T3.

As described heretofore, according to this exemplary embodiment, the fixing device 20 of the image forming apparatus 1 is kept in the standby state at the standby temperature corresponding to the voltage value of the power supply 25. Accordingly, excessive consumption of power by the fixing device 20 is suppressed. Further, the change amount of the standby temperature is acquired based on the voltage value of the power supply 25. Accordingly, the standby temperature of the fixing device 20 is set accurately. Furthermore, the change amount of the standby temperature is converted from the voltage value of the power supply 25 based on the conversion table. Accordingly, the standby temperature of the fixing device 20 is set in a relatively simple manner. Furthermore, the AC-DC converter 30 converts the AC voltage value of the power supply 25 to the DC voltage value to enable the A/D converter 31 to detect the voltage value of the power supply 25 in a relatively simple manner and accurately in accordance with the resolution of the A/D converter 31.

Hereinafter, a description is given of the image forming apparatus 1 according to another exemplary embodiment of the present invention. The image forming apparatus 1 according to the following exemplary embodiment is substantially similar in configuration to the information processing apparatus 1 according to the exemplary embodiment described above, and produces similar effects. Accordingly, a description of elements, members, components, or operations that are same as those of the exemplary embodiment described above will be omitted below. In the drawings and description of the following exemplary embodiments, the same reference numbers are allocated to elements (members or components) having the same function or shape as those of the exemplary embodiment described above.

In this exemplary embodiment, the standby temperature setting unit 39 (FIG. 4) acquires the change amount of the standby temperature corresponding to the voltage value of the power supply 25 based on a predetermined relational expression in place of the conversion table as illustrated in FIG. 6. The standby temperature setting unit 39 determines the standby temperature of the fixing device 20 based on the acquired change amount of the standby temperature. The relational expression indicates the change amount of the standby temperature corresponding to the voltage value of the power supply 25. Based on the relational expression, the voltage value of the power supply 25 is converted to the change amount of the standby temperature. The relation expression is set in advance and stored in the memory 36.

In this exemplary embodiment, the standby temperature setting unit 39 subtracts the lower voltage limit from the voltage value of the power supply 25 to obtain the voltage difference. Then, the standby temperature setting unit 39 multiplies the obtained voltage difference by a predetermined coefficient to obtain the change amount of the standby temperature. Accordingly, the relational expression is as follows:

Change amount of standby temperature=(Voltage value of power supply−Lower voltage limit)*Coefficient Thus, based on the above relational expression, the change amount (degree Celsius) of the standby temperature is calculated. The standby temperature setting unit 39 acquires the relational expression from the memory 36, and uses the relational expression to calculate the change amount from the voltage value of the power supply 25.

In other words, the processor 32 of the image forming apparatus 1 executes the program stored in the ROM 34 to perform the operation of calculating the change amount of the standby temperature based on the voltage value of the power supply 25. The standby temperature setting unit 39 changes the setting of the standby temperature from the reference standby temperature based on the acquired changed amount of the standby temperature. In this example, the standby temperature setting unit 39 subtracts the change amount from the reference standby temperature to set the standby temperature of the fixing device 20. The calculation of the change amount of the standby temperature using the relational expression makes it possible to change the setting of the standby temperature of the fixing device 20 in a relatively simple manner.

In addition, the standby temperature setting unit 39 compares the voltage value of the power supply 25 with the standard of the voltage value (e.g., the upper voltage limit and the lower voltage limit). When the comparison result indicates that the voltage value of the power supply 25 is greater than or equal to the lower voltage limit and less than or equal to the upper voltage limit, the standby temperature setting unit 39 calculates the change amount of the standby temperature using the relational expression. The coefficient of the relational expression is determined, for example, by experiment, and is set depending on different models or types of the image forming apparatus 1. The relational expression is either linear or non-linear.

Figure 8:
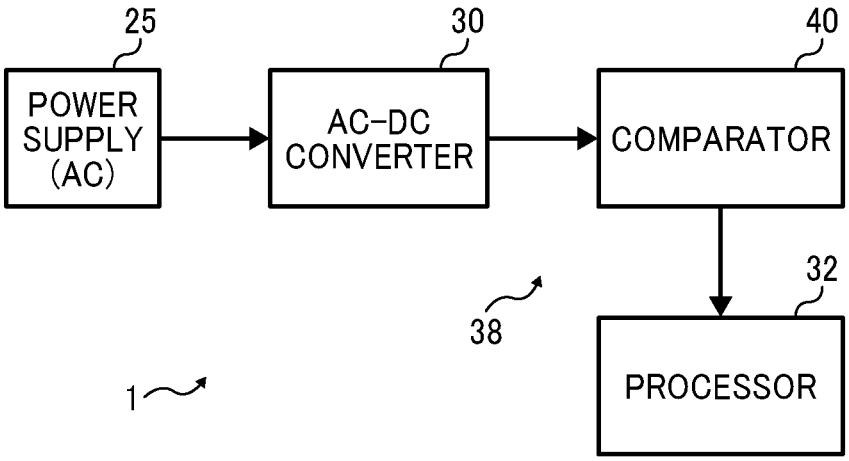
FIG. 8 is a block diagram illustrating a hardware configuration to detect a voltage value of a power supply in the image forming apparatus of FIG. 1 according to another embodiment of the present invention.

FIG. 8 is a block diagram illustrating a configuration to detect the voltage value of the power supply 25 in the image forming apparatus 1 according to still another exemplary embodiment of the present invention.

In this exemplary embodiment, as illustrated in FIG. 8, the image forming apparatus 1 includes the AC-DC converter 30, which is connected to the power supply 25, a comparator 40, and the processor 32. The comparator 40 is implemented by, for example, a comparison circuit that compares the DC voltage value, which is converted by the AC-DC converter 30, with a predetermined reference voltage value to determine whether the DC voltage value is greater than the reference voltage value.

The image forming apparatus 1 causes the comparator 40 to determine whether the voltage value of the power supply 25 is close to the lower voltage limit. In addition, the image forming apparatus 1 causes the comparator 40 to compare the DC voltage value with a plurality of the reference voltage values to determine the voltage value of the power supply 25. The determination result is output to the processor 32. The processor 32 uses the determination result to perform the operation for changing the setting of the standby temperature of the fixing device 20. The reference voltage values of the comparator 40 are set in advance to correspond the voltage values set in the conversion table (FIG. 6), for example. The comparator 40 makes it possible to detect the voltage value of the power supply 25 in a relatively simple manner without the A/D converter 31 provided with the image forming apparatus 1.

Figure 9:
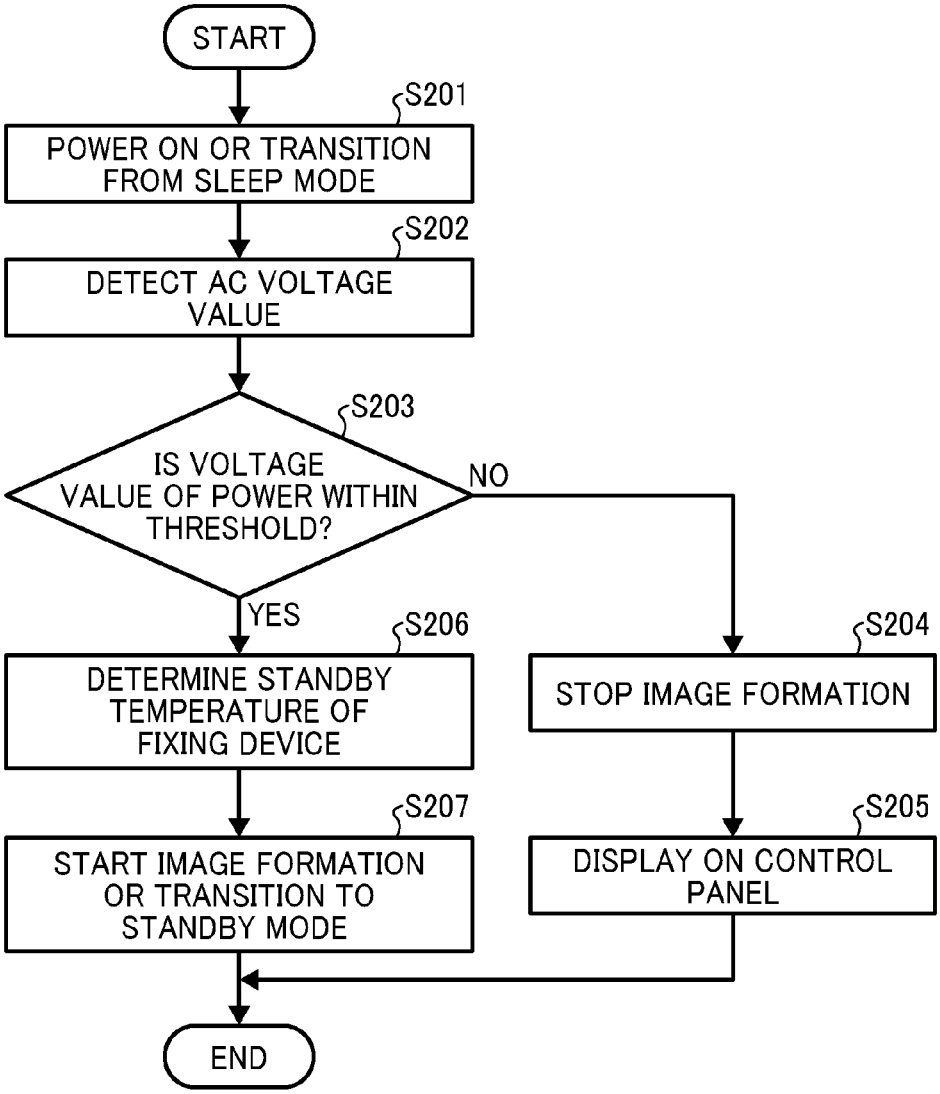
FIG. 9 is a flowchart illustrating an operation of controlling temperature of a fixing device of the image forming apparatus according to still another embodiment of the present invention.

FIG. 9 is a flowchart illustrating an operation of controlling the temperature of the fixing device 20 according to still another exemplary embodiment of the present invention.

In this exemplary embodiment, as illustrated in FIG. 9, when the image forming apparatus 1 is turned on, or, when the image forming apparatus 1 transitions from a sleep mode (S201), the voltage value detection unit 38 detects the AC voltage value of the power supply 25 (S202). Subsequently, the processor 32 compares the voltage value of the power supply 25 with a predetermined threshold to determine whether the voltage value of the power supply 25 satisfies a predetermined condition of the threshold. When the determination result indicates that the voltage value of the power supply 25 does not satisfy the predetermined condition of the threshold, the processor 32 stops image formation by the image forming apparatus 1.

In other words, the processor 32 of the image forming apparatus 1 executes the program stored in the ROM 34 to perform the operation of determining whether the voltage value of the power supply 25 satisfies a condition of the threshold of the voltage value and the operation of stopping image formation based on the determination result. When the processor 32 determines that the voltage value of the power supply 25 satisfies the predetermined condition of the threshold, the standby temperature setting unit 39 changes the setting of the standby temperature of the fixing device 20 from the reference standby temperature based on the voltage value of the power supply 25. Any desired value may be set as the threshold of the voltage value of the power supply 25 in accordance with a product standard or a nominal voltage value. For example, the upper voltage limit and the lower voltage limit are set as the threshold. In this example, the processor 32 determines whether the voltage value of the power supply 25 is greater than or equal to the upper voltage limit and whether the voltage value of the power supply 25 is less than or equal to the lower voltage limit.

In this exemplary embodiment, the processor 32 determines whether the voltage value of the power supply 25 is within a range between the two thresholds, e.g., the lower voltage limit and the upper voltage limit (S203). When the voltage value of the power supply 25 is greater than the upper voltage limit, or, when the voltage value of the power supply 25 is less than the lower voltage limit, the processor 32 determines that the voltage value of the power supply 25 is not within a range between the two thresholds (S203: NO). Based on such determination result, the processor 32 stops image formation by the image forming apparatus 1 (S204). Further, the processor 32 displays an image or video indicating that the image formation is stopped or a warning about the voltage value on, for example, the control panel of the image forming apparatus 1 (S205).

When the processor 32 determines that the voltage value of the power supply 25 is within a range between the two thresholds (S203: YES), the standby temperature of the fixing device 20 is set by substantially similar operations as those of S102 to S105 of FIG. 5 (S206). After S205, the image forming apparatus 1 starts forming an image, or the fixing device 20 keeps waiting for the start of image formation at the standby temperature (S207). As described heretofore, according to this exemplary embodiment, an operation of forming an image is stopped based on the voltage value of the power supply 25. This prevents the image forming apparatus 1 from malfunctioning.

Figure 10:
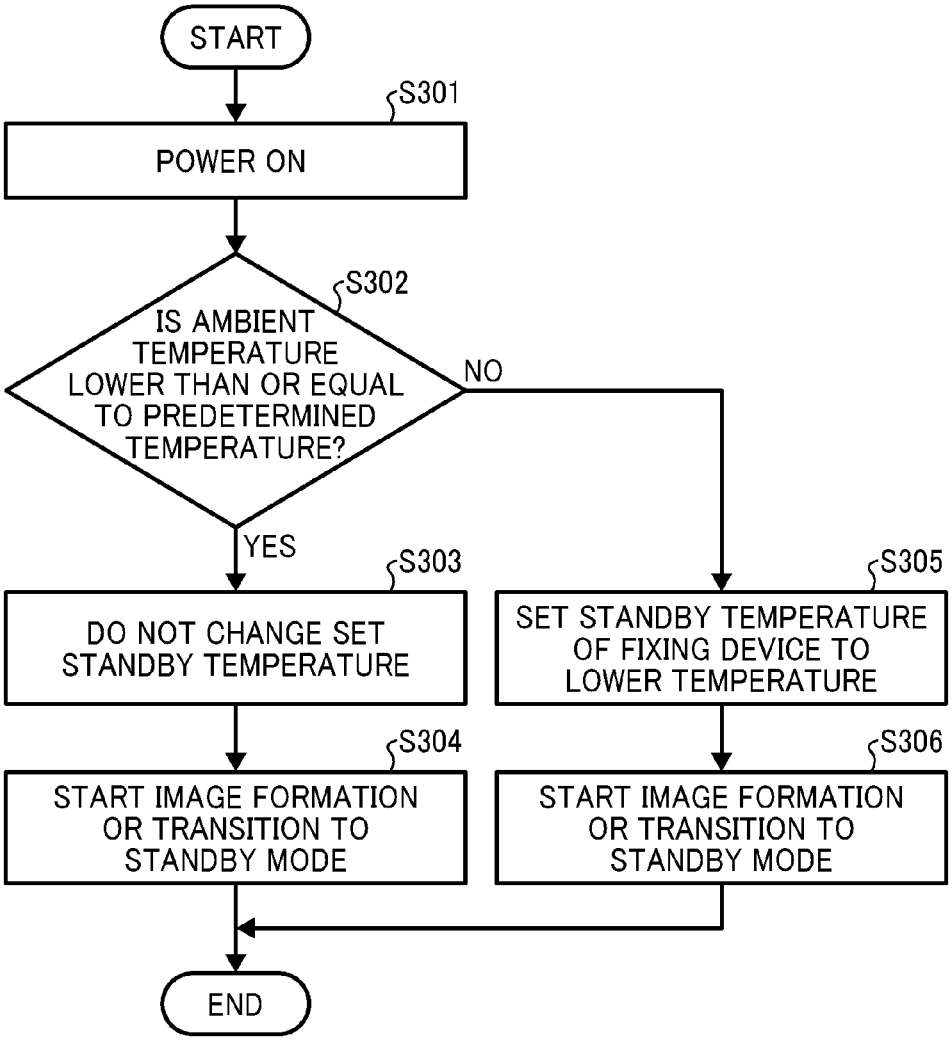
FIG. 10 is a flowchart illustrating an operation of controlling temperature of a fixing device of the image forming apparatus according to still another embodiment of the present invention.

FIG. 10 is a flowchart illustrating an operation of controlling the temperature of the fixing device 20 according to still another exemplary embodiment of the present invention.

In this exemplary embodiment, as illustrated in FIG. 10, when the image forming apparatus 1 is turned on (S301), the standby temperature of the fixing device 20 is set by substantially similar operations as those of S102 to S105 of FIG. 5. Subsequently, a temperature measurement device provided with the image forming apparatus 1 measures ambient temperature of the image forming apparatus 1. In addition, the measurement device outputs a measurement result, i.e., the measured ambient temperature, to the controller 33 of the image forming apparatus 1. The measurement device is implemented by, for example, a temperature sensor or a thermistor. The ambient temperature of the image forming apparatus 1 is the temperature of air in adjacent areas of the image forming apparatus 1.

The processor 32 of the image forming apparatus 1 compares the measured ambient temperature with a predetermined temperature to determine whether the ambient temperature of the image forming apparatus 1 is lower than or equal to the predetermined temperature (S302). The predetermined temperature to be compared with the ambient temperature is a reference temperature of the ambient temperature, which is set in advance and stored in the memory 36. The processor 32 compares the ambient temperature with the predetermined temperature to determine whether to change the setting of the standby temperature of the fixing device 20 from the reference standby temperature based on the comparison result. When the processor 32 determines that the setting of the standby temperature is to be changed based on the comparison result, the processor 32 changes the setting of the standby temperature to adjust the standby temperature of the fixing device 20 in accordance with the ambient temperature. In other words, the processor 32 of the image forming apparatus 1 executes the program stored in the ROM 34 to perform the operation of adjusting the standby temperature of the fixing device 20 based on the ambient temperature of the image forming apparatus 1.

When the processor 32 determines that the ambient temperature is lower than or equal to the reference temperature (S302: YES), the processor 32 does not change the setting of the standby temperature from the standby temperature set with the substantially similar operations as those of S102 to S105 of FIG. 5 (S303). After S305, the image forming apparatus 1 starts forming an image, or the fixing device 20 keeps waiting for the start of image formation at the standby temperature (S304). In contrast, in a case where the ambient temperature is higher than the reference temperature, a rate of rise in the temperature of the fixing device 20 when heated increases. Accordingly, when the processor 32 determines that the ambient temperature is higher than the reference temperature (S302: NO), the processor 32 sets the standby temperature of the fixing device 20 to a temperature that is lower than the standby temperature that is preset with the substantially similar operations as those of S102 to S105 of FIG. 5.

Specifically, the processor 32 acquires a predetermined change amount of the standby temperature from the memory 36, and lowers the preset standby temperature by the change amount to adjust the standby temperature. Thus, the processor 32 sets the standby temperature, which is a temperature up to which the fixing device is to be heated and maintained in the standby state, to a temperature that is lower than the standby temperature that is preset with the substantially similar operations as those of S102 to S105 of FIG. 5 (S305). After S305, the image forming apparatus 1 starts forming an image, or the fixing device 20 keeps waiting for the start of image formation at the standby temperature (S306). As described heretofore, according to this exemplary embodiment, the setting of the standby temperature of the fixing device 20 is adjusted in accordance with the ambient temperature of the image forming apparatus 1.

Figure 11:
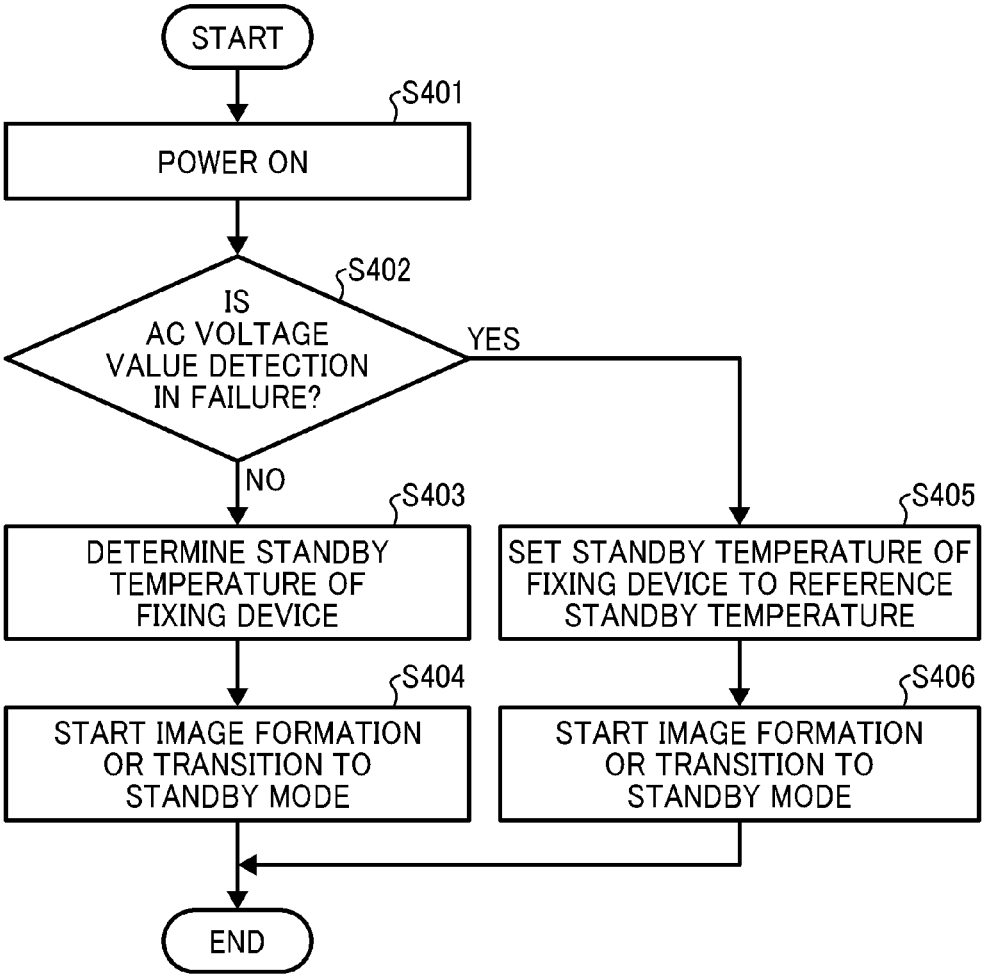
FIG. 11 is a flowchart illustrating an operation of controlling temperature of a fixing device of the image forming apparatus according to still another embodiment of the present invention.

FIG. 11 is a flowchart illustrating an operation of controlling the temperature of the fixing device 20 according to still another exemplary embodiment of the present invention.

In this exemplary embodiment, as illustrated in FIG. 11, when the image forming apparatus 1 is turned on (S401), the processor 32 of the image forming apparatus 1 detects a status of the voltage value detection unit 38 to determine whether the voltage value detection unit 38 is in failure (S402). For example, the processor 32 determines that the voltage value detection unit 38 is in failure, when the voltage value of the power supply 25 that is detected by the voltage value detection unit 38 is fixed at the upper voltage limit or the lower voltage limit due to open circuit faults or short circuit faults.

When the processor 32 determines that the voltage value detection unit 38 is not in failure (S402: NO), the standby temperature of the fixing device 20 is set by substantially similar operations as those of S102 to S105 of FIG. 5 (S403). After S403, the image forming apparatus 1 starts forming an image, or the fixing device 20 keeps waiting for the start of image formation at the standby temperature (S404). In contrast, when the determination result indicates that the voltage value detection unit 38 is in failure, the processor 32 of the image forming apparatus 1 prevents the standby temperature setting unit 39 from changing the setting of the standby temperature from the reference standby temperature. In other words, the processor 32 executes the program stored in the ROM 34 to perform the operation of determining whether the voltage value detection unit 38 is in failure and the operation of preventing the standby temperature setting unit 39 from changing the setting of the standby temperature.

When the processor 32 determines that the voltage value detection unit 38 is in failure (S402: YES), the standby temperature setting unit 39 does not change the setting of the standby temperature from the reference standby temperature (S405). After S405, the image forming apparatus 1 starts forming an image, or the fixing device 20 keeps waiting for the start of image formation at the standby temperature (S406). As described heretofore, according to this exemplary embodiment, the operation of changing the setting of the standby temperature is canceled in response to the failure of the voltage value detection unit 38.

Numerous additional modifications and variations are possible in light of the above teachings. It is therefore to be understood that, within the scope of the appended claims, the disclosure of the present invention may be practiced otherwise than as specifically described herein. For example, elements and/or features of different illustrative embodiments may be combined with each other and/or substituted for each other within the scope of this disclosure and appended claims.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. An image forming apparatus comprising:

a fixing device to fix an image formed on a recording medium at a fixing temperature, the fixing device including a heater to heat the fixing device with power from a power supply; and a processor to:

detect a voltage value of the power supply;

set a standby temperature of the fixing device based on the detected voltage value of the power supply;

control operation of the heater to heat the fixing device from the standby temperature to the fixing temperature in response to receiving an instruction for forming an image;

determine whether to change a setting of the standby temperature from a reference standby temperature based on the detected voltage value of the power supply; and determine a change amount of the standby temperature based on the detected voltage value of the power supply, in response to the processor determining that the setting of the standby temperature is to be changed, wherein the processor is configured to change the standby temperature based on the determined change amount of the standby temperature.

2. The image forming apparatus according to claim 1, wherein the processor is further configured to:

compare the voltage value of the power supply with a voltage limit; and determine whether to change the standby temperature to a temperature relatively lower than a reference standby temperature corresponding to the voltage limit, based on the comparing of the voltage value of the power supply with the voltage limit.

3. The image forming apparatus according to claim 1, further comprising a memory to store a conversion table defining respective change amounts of the standby temperature in association with respective voltage values of the power supply, wherein the processor is configured to acquire the change amount of the standby temperature, associated with the detected voltage value of the power supply, from the conversion table.

4. The image forming apparatus according to claim 1, further comprising a memory to store a relational expression representing a relation between a voltage value of the power supply and a change amount of the standby temperature, wherein the processor is configured to determine the change amount by calculating the change amount of the standby temperature from the detected voltage value of the power supply and the relational expression.

5. The image forming apparatus according to claim 1, wherein the processor is further configured to:

determine whether the detected voltage value of the power supply satisfies a threshold; and cancel image formation, in response to the processor determining that the detected voltage value of the power supply does not satisfy the threshold.

6. The image forming apparatus according to claim 1, wherein the processor is further configured to change the standby temperature based on ambient temperature of the image forming apparatus.

7. The image forming apparatus according to claim 1, wherein the processor is further configured to:

determine whether or not the detecting of the voltage value indicates that a voltage detection unit is in failure; and change the standby temperature to a reference standby temperature, in response to the processor determining that the detecting of the voltage value indicates that a voltage detection unit is in failure.

8. A method for controlling image formation by an image forming apparatus, the method comprising:

detecting a voltage value of a power supply, the power supply supplying power to a heater that heats a fixing device of the image forming apparatus;

setting a standby temperature of the fixing device based on the detected voltage value of the power supply;

controlling operation of the heater to heat the fixing device from the standby temperature to a fixing temperature at which the fixing device fixes the image on a recording medium, in response to receiving an instruction for forming an image;

determining whether to change a setting of the standby temperature from a reference standby temperature based on the detected voltage value of the power supply; and determining a change amount of the standby temperature based on the detected voltage value of the power supply, in response to determining that the setting of the standby temperature is to be changed, wherein the standby temperature is changed based on the determined change amount of the standby temperature.

9. The method of claim 8, further comprising:

comparing the voltage value of the power supply with a voltage limit; and determining whether to change the standby temperature to a temperature relatively lower than a reference standby temperature corresponding to the voltage limit, based on the comparing.

10. The method of claim 8, further comprising:

storing a conversion table defining respective change amounts of the standby temperature in association with respective voltage values of the power supply; and determining the change amount of the standby temperature, associated with the detected voltage value of the power supply, from the conversion table.

11. The method of claim 8, further comprising:

storing a relational expression representing a relation between a voltage value of the power supply and a change amount of the standby temperature; and determining the change amount by calculating the change amount of the standby temperature from the detected voltage value of the power supply using the relational expression.

12. The method of claim 8, further comprising:

determining whether the detected voltage value of the power supply satisfies a threshold; and cancelling image formation, in response to determining that the detected voltage value of the power supply does not satisfy the threshold.

13. The method of claim 8, further comprising:

changing the standby temperature based on ambient temperature of the image forming apparatus.

14. The method of claim 8, further comprising:

determining whether or not the detecting of the voltage value indicates that a voltage detection unit is in failure; and changing the standby temperature to a reference standby temperature, in response to determining that the detecting of the voltage value indicates that a voltage detection unit is in failure.

15. A non-transitory machine-readable recording medium storing a program for causing an image forming apparatus to perform a method for controlling image formation, comprising:

detecting a voltage value of a power supply, the power supply supplying power to a heater that heats a fixing device of the image forming apparatus;

setting a standby temperature of the fixing device based on the detected voltage value of the power supply;

controlling operation of the heater to heat the fixing device from the standby temperature to a fixing temperature at which the fixing device fixes the image on a recording medium, in response to receiving an instruction for forming an image;

determining whether to change a setting of the standby temperature from a reference standby temperature based on the detected voltage value of the power supply; and determining a change amount of the standby temperature based on the detected voltage value of the power supply, in response to determining that the setting of the standby temperature is to be changed, wherein the standby temperature is changed based on the determined change amount of the standby temperature.

16. The non-transitory machine-readable recording medium of claim 15, storing the program for causing an image forming apparatus to perform the method for controlling image formation, the method further comprising:

comparing the voltage value of the power supply with a voltage limit; and determining whether to change the standby temperature to a temperature relatively lower than a reference standby temperature corresponding to the voltage limit, based on a result of the comparing.

17. The non-transitory machine-readable recording medium of claim 15, storing the program for causing an image forming apparatus to perform the method for controlling image formation, the method further comprising:

storing a conversion table defining respective change amounts of the standby temperature in association with respective voltage values of the power supply; and determining the change amount of the standby temperature, associated with the detected voltage value of the power supply, from the conversion table.

18. The non-transitory machine-readable recording medium of claim 15, storing the program for causing an image forming apparatus to perform the method for controlling image formation, the method further comprising:

storing a relational expression representing a relation between a voltage value of the power supply and a change amount of the standby temperature; and determining the change amount by calculating the change amount of the standby temperature from the detected voltage value of the power supply using the relational expression.

19. The non-transitory machine-readable recording medium of claim 15, storing the program for causing an image forming apparatus to perform the method for controlling image formation, the method further comprising:

determining whether the detected voltage value of the power supply satisfies a threshold; and cancelling image formation, in response to determining that the detected voltage value of the power supply does not satisfy the threshold.

20. The non-transitory machine-readable recording medium of claim 15, storing the program for causing an image forming apparatus to perform the method for controlling image formation, the method further comprising:

changing the standby temperature based on ambient temperature of the image forming apparatus.

* * * * *